US006923132B1

(12) United States Patent
McKenzie

(10) Patent No.: US 6,923,132 B1
(45) Date of Patent: Aug. 2, 2005

(54) WATERCRAFT LIFT ASSEMBLY

(76) Inventor: John McKenzie, 5101 Stokely La., Knoxville, TN (US) 37918

( * ) Notice: Subject to any disclaimer, the term of this patent is extended or adjusted under 35 U.S.C. 154(b) by 0 days.

(21) Appl. No.: 10/772,119

(22) Filed: Feb. 4, 2004

(51) Int. Cl.[7] ..... B63C 7/00
(52) U.S. Cl. ..... 114/44; 114/373
(58) Field of Search ..... 114/44, 45, 48, 114/49, 258–260, 263, 316, 375

(56) References Cited

U.S. PATENT DOCUMENTS 2,821,315 A * 1/1958 Bucher ..... 414/477
3,858,541 A 1/1975 Metcalf, Jr. et al.
4,142,477 A 3/1979 Powers
4,212,580 A 7/1980 Fluck
4,274,788 A 6/1981 Sutton
5,603,600 A * 2/1997 Egan et al. ..... 414/462
5,641,242 A * 6/1997 Riviere ..... 405/3
5,645,007 A 7/1997 Benton
6,357,991 B1 3/2002 Hamlett
6,602,022 B1 * 8/2003 Wilkins ..... 405/3

* cited by examiner

*Primary Examiner*—Jesus D. Sotelo
(74) *Attorney, Agent, or Firm*—Pitts & Brittian, P.C.

(57) ABSTRACT

An apparatus for securing a watercraft to another vessel or platform with a rack assembly. The rack assembly is adapted to lift and carry a watercraft out of the water. The rack assembly has a pair of rails adapted to support the watercraft. The pair of rails pivot whereby the ends of the pair of rails moves from a submerged position suitable for driving the watercraft onto the pair of rails to a raised position with the ends of the pair of rails is above the water level.

19 Claims, 5 Drawing Sheets

WATERCRAFT LIFT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to an apparatus for securing a personal watercraft to another vessel. More particularly, this invention pertains to rack assembly adapted to lift and carry the watercraft out of the water. The rack assembly is attached to another vessel or a platform.

2. Description of the Related Art

Personnel watercraft are powered water vessels that carry one or more persons in a manner similar to riders of a motorcycle where the riders sit astride the vehicle. Watercraft are typically smaller than traditional water vessels and are often used with other watercraft, such as houseboats, pontoon boats, or platform boats.

There is a need to secure and transport watercraft during the period the watercraft are in the water, but not being used. It is known to use a crane or davit secured to another vessel or dock to hoist or lift a watercraft out of the water. Such a system, because of the lever arm involved, places high stress at the connection of the davit to the vessel or dock deck. Further, such a system requires that the davit have a height sufficient to accommodate the height of the watercraft as it is lifted out of the water. Additionally, it is desirable to be able to secure and transport watercraft without using valuable deck space on the vessel.

Several patents disclose various apparatus for storing watercraft or other small water vessels. U.S. Pat. No. 5,603,600, titled "Telescoping Personal Watercraft Jet Track," issued to Egan, et al., on Feb. 18, 1997, discloses an apparatus for loading and unloading a watercraft into a pickup truck bed 50. The Egan apparatus includes two telescoping ramp members 21, 22 forming a ramp assembly 20 that is connected to a support frame 12 positioned inside the truck bed 50. The watercraft is positioned on a sled 40, which is mounted on one telescoping member 22. A winch system 60 pulls the telescoping members 21, 22 together, and as the center of gravity passes the pivot point 32, the telescoping members 21, 22 pivot until they are parallel with the upper surface of the support frame 12. U.S. Pat. No. 6,357,991, titled "Combination Watercraft Transportation System and Dolly," issued to Hamlett on Mar. 19, 2002, discloses another apparatus that includes a rack adapted fit to a pickup truck T in which a water vessel is winched onto a rail mechanism 12. The system 10 includes a pair of pivotal legs 13 and a hand crank 52 for racking the rail mechanism 12 into the truck T for transporting the watercraft.

U.S. Pat. No. 4,274,788, titled "Vehicle Mounted Carriage and Elevating Apparatus," issued to Sutton on Jun. 23, 1981, discloses an assembly 10 for elevating and carrying a small boat on a land vehicle, such as a pickup truck. The apparatus 10 includes a support 20 and a rear post frame 60 mounted to a truck bed V, and a carriage 80 with bolsters 92 for supporting a boat. The carriage 80 is lowered into the water and a hook on a cable 93 attached to the winch 98 is secured to the boat. The winch 98 pulls the boat on the carriage 80 out of the water. Another winch 100 connects to a lifting line, or cable, 95 and a plurality of pulleys 27, 45, 25, 90, and winch 100 is used to rotate link frame 40 about pivot pins 50 from a substantially horizontal position to a vertical position, thereby elevating the boat and shifting the boat over the vehicle.

U.S. Pat. No. 5,645,007, titled "Personal Watercraft Mooring and Transportation System," issued to Benton on Jul. 8, 1997, discloses a personal watercraft mooring system 10 in which the watercraft 34 is moored to another water vessel. The mooring system 10 includes a receptacle 38 in which the watercraft 34 is driven onto, and the receptacle 38 buoyantly supports the watercraft 34. The receptacle 38 is generally V-shaped to accommodate the watercraft 34 as it slides into the receptacle 38 and is nestled therein. The sidewalls of the receptacle 38 confine and provide support to the watercraft 34 when it is partially out of the water. The receptacle 38 is attached to the vessel 12 with a coupling 66, which can be rigid, include pivots 70, or includes supports 80 for a vertical displacement mount 82.

BRIEF SUMMARY OF THE INVENTION

According to one embodiment of the present invention, a rack assembly adapted to lift and carry a watercraft out of the water is provided. The rack assembly includes a pair of rails adapted to lift and carry a watercraft. The pair of rails rotate about a pivot point to lift the watercraft and position it in a stowed position. A winch with a cable or strap running through a pulley and to the watercraft provides the force necessary to pull the watercraft onto the rack assembly and rotate the pair of rails into the stowed position. In one embodiment, the rack assembly is adapted to mount on a swim platform of a vessel, such as a houseboat. The pair of rails, in one embodiment, have runners for the watercraft to slide against. In another embodiment, each of the rails has a friction strip that prevents the watercraft from sliding along a portion of the rails.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for securing a watercraft to another vessel or platform is disclosed. The rack assembly is adapted to lift and carry a watercraft out of the water without the use of davits and cranes and their concomitant vertical cables and spreader bars. The apparatus uses a single winch to pull the watercraft into position and to stow the watercraft.

Figure 1:
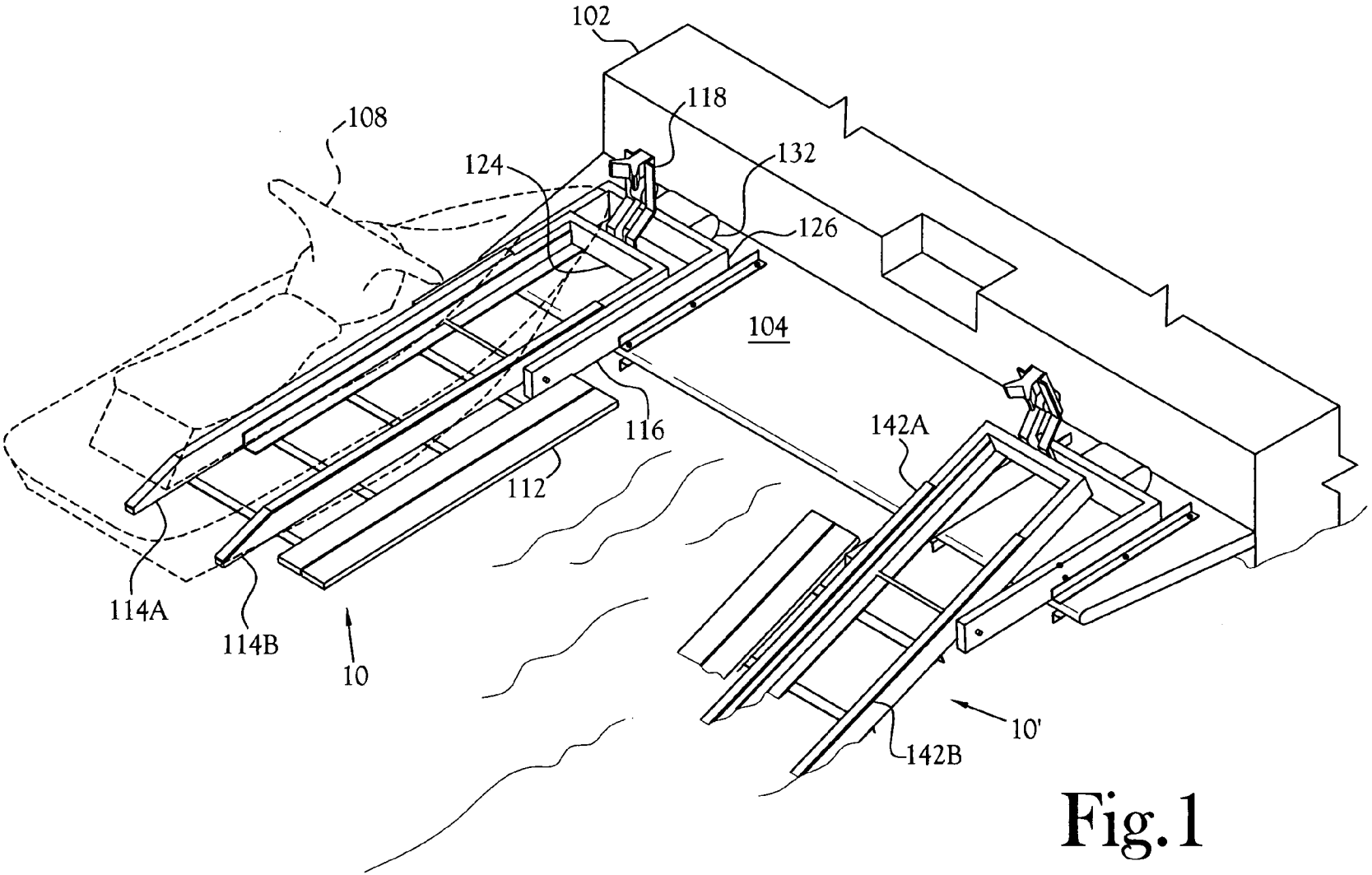
FIG. 1 is a perspective view of a boat transom having two rack assemblies attached.

FIG. 1 illustrates an aft end of a boat 102 with two rack assemblies 10, 10' mounted to a swim platform 104. One rack assembly 10 shows a personal watercraft 108 in the stowed, out-of-the-water position. The other rack assembly 10' shows the rails 114A, 114B partially submerged with the rack assembly 10' in a loading position ready for a watercraft 108 to be driven onto the rack assembly 10' for stowing. In the illustrated embodiment, the rack assemblies 10, 10' are attached to a swim platform 104. In another embodiment, the rack assemblies 10, 10' are attached to a surface of the vessel 102, such as a deck, that is near the water surface. In still another embodiment, the rack assemblies 10, 10' are attached to a platform, such as a dock, a floating dock, a wharf, or a pier.

A pair of support arms, or support members, 116A, 116B are attached to the swim platform 104. In the illustrated embodiment, the pair of support arms 116 are connected with a cross-member 126 at their inboard, or forward, end. At the outboard, or aft, end of the support arms 116 is a connection or pivot 206 for the rails 114.

The inboard side of the rack assembly 10 has a walkboard, or platform, 112 attached to the rails 114 to aid the watercraft user in mounting and dismounting the watercraft 108. Depending upon the beam of the vessel 102, the swim platform 104 can accommodate one or more rack assemblies 10, 10' while still having room available for use of the swim platform 104 as a swim platform. In one embodiment, with two rack assemblies 10, 10' on a swim platform 104, the winches 132 have their controls positioned inboard so as to allow an operator to stand between the rack assemblies 10, 10'. In one embodiment, the winches 132 are electrically operated. In another embodiment, the winches 132 are hand-operated winches.

Figure 2:
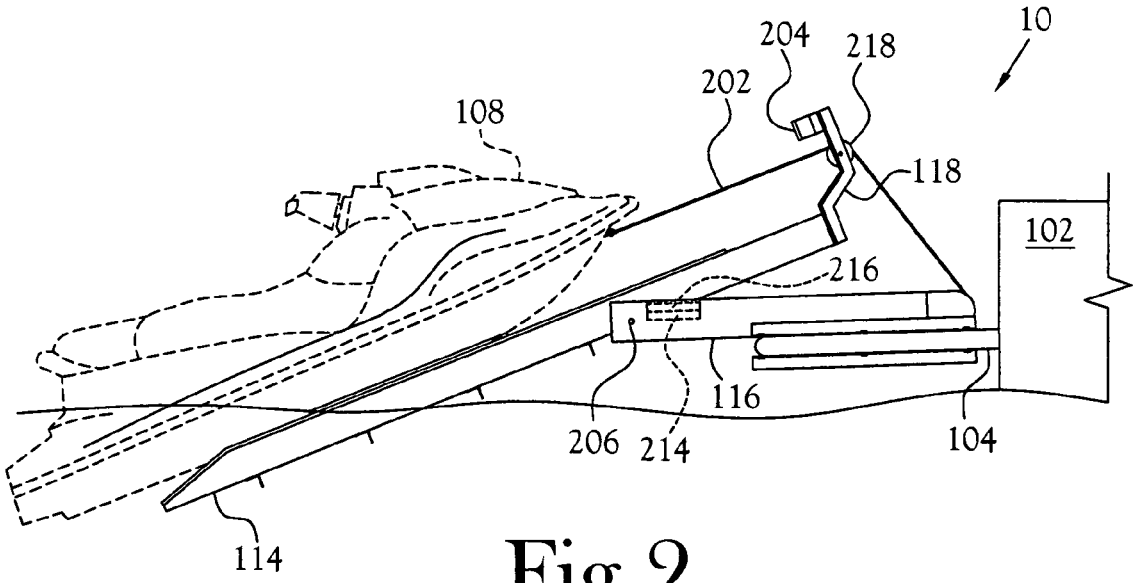
FIG. 2 is a side view of one embodiment of a rack assembly with a watercraft being pulled onto the rack assembly.
Figure 3:
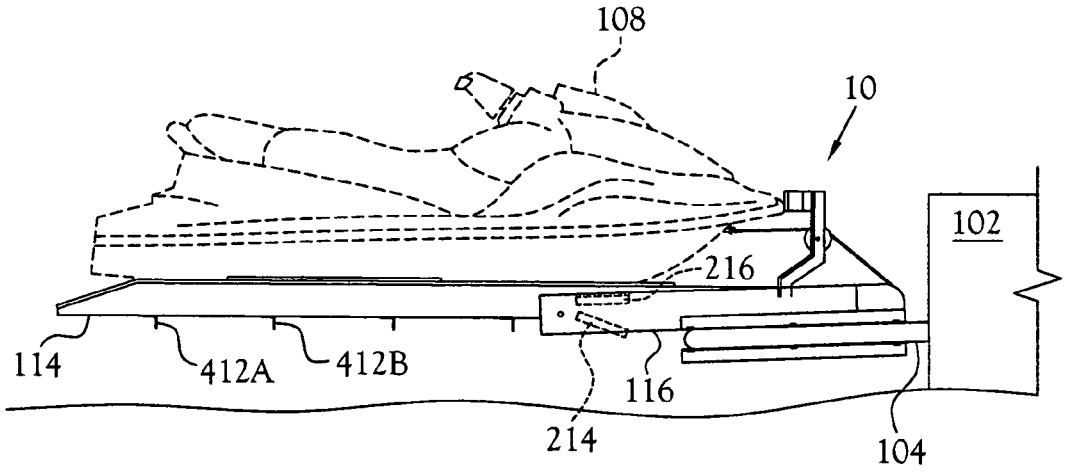
FIG. 3 is a side view of the rack assembly of FIG. 2 showing the watercraft in a stowed, out-of-the-water position.

FIG. 2 illustrates the rack assembly 10 in position to begin pulling the watercraft 108 out of the water or, alternatively, to release the watercraft 108 to be driven away from the vessel 102. The rails 114 illustrated in FIG. 2 are in a loading position, which is the same position as an unloading position. The loading position is a stable position in which the rails 114 are angled relative to the water such that a watercraft 108 in the water can be driven partially onto the rails 114 until the watercraft 108 engages the friction stops 424 (illustrated in FIG. 4). In this position, the operator can disembark the watercraft 108 by stepping on the walkboard 112 and the watercraft 108 is held in a stable position. With the watercraft 108 in this position, the operator can hook to watercraft 108 to the winch cable, or strap, 202. FIG. 3 illustrates the watercraft 108 in the stowed position, out of the water. The stowed position is a stable position in which the rails 114 are secured rigidly with the watercraft 108 out of the water.

The pair of rails 114 are connected at their inboard end by a cross-piece 124. Projecting upwards from the cross-piece 124 is an upright arm 118. The upright arm 118 supports a pulley 218 and a bumper 204 that mates to the bow of the watercraft 108. The cable 202 extending from the winch 132 passes over the pulley 218 and connects to the watercraft 108 with a hook or other attachment means. In one embodiment, the cable 202 is a rope, either a wire rope or a flexible rope such as one made of nylon or other material, extending from a spool at the winch 132 to a hook or other attachment device. In another embodiment, the cable 202 is a strap, which is a flat, flexible member. In still another embodiment the cable 202 is a strap adapted to fit within the spool without shifting from side to side. A strap-type a cable 202 is suited for not kinking and allows for easy stowing in this application. In one embodiment, the cable 202 is a two-inch wide strap used with a spool having a throat slightly wider than two-inches. The cable (strap) 202 is wound on the spool with each layer on top of a lower layer and the walls of the spool serve to prevent the strap from wandering or shifting from side to side. The end of the cable 202 opposite the winch 132 has a hook or other attachment device for connecting to the watercraft 108, and when the cable 202 is not attached to a watercraft 108, it drapes over the rack assembly 10 without automatically coiling or kinking.

In the illustrated embodiment, the pair of rails 114 are separate members. In another embodiment, the pair of rails 114 are an integral rail member fabricated in one piece. The rail member is adapted to receive the watercraft 108 and rotate about the pivot point 206. In another embodiment, the rail member includes an integral bumper 204 and the rail member is adapted to cradle the watercraft 108.

Referring to FIG. 2, when a watercraft 108 is ready to be stowed on the rack assembly 10, the watercraft 108 is driven onto the rails 114. A hook at the end of the winch cable 202 is attached to an eye at the bow of the watercraft 108. The winch cable 202 runs from the winch 132, through the pulley 218 on the upright arm 118, and to the hook which is attached to the watercraft 108. The winch 132 is operated to draw in the cable 202 and slide the watercraft 108 along the rails 114 of the rack assembly 10. When the bow of the watercraft 108 contacts the bumper 204 on the upright arm 118, the watercraft 108 is prevented from moving or sliding along the rails 114, and the rails 114 are rotated about a pivot point 206 as the cable 202 continues to be retracted by the winch 132, thereby raising the rails 114 and the watercraft 108 out of the water.

The winch 132 continues to draw in the cable 202 until the rails 114 are positioned as illustrated in FIG. 3. In one embodiment, the winch 132 stops when the rails 114 actuate a limit switch indicating that the rails 114 have reached the stowed position. In another embodiment, the winch 132 stops when the inboard bottom edge of the rails 114 or the cross-piece 124 contacts the swim platform 104, thereby causing the winch 132 to sense an overload condition and stop. The tension on the cable 202, in combination with the rails 114 contacting the swim platform 104, serves to maintain the rails 114 and the watercraft 108 in the stowed position.

In the illustrated embodiment, the pivot 206 is positioned such that, with the watercraft 108 in the stowed position, a portion of the watercraft 108 weight is forward of the pivot 106. This weight distribution, in combination with the lever arm of the rails 114 forward of the pivot 206, minimizes the forces to lift the rails 114 and the watercraft 108 to a stowed position. The slick runners 142 reduce the frictional forces in sliding the watercraft 108 along the rails 114, further minimizing the force required to move the watercraft 108 in position for stowing.

Referring to FIG. 2, a rail stop 214 on the rails 114 contacts a support stop 216 on the support arms 116A, 116B, thereby limiting the drop of the rails 114. The rail stop 214 in one embodiment, is bar stock welded or otherwise secured to each rail 114A, 114B. The corresponding support stop 216 is bar stock welded or otherwise secured to each support arm 116A, 116B. As the rails 114 rotate about the pivot 206, the two stops 214, 216 move relative to each other. The two stops 214, 216 make contact when the rails 114 drop into the water and the rails 114 are in the loading position, and the stops 214, 216 separate when the winch 132 pulls the rails 114 to a stowed position. Those skilled in the art will recognize that either a single set of stops 214, 216 or a set of stops 214, 216 on each rail 114A, 114B can be used without departing from the spirit and scope of the present invention.

Figure 4:
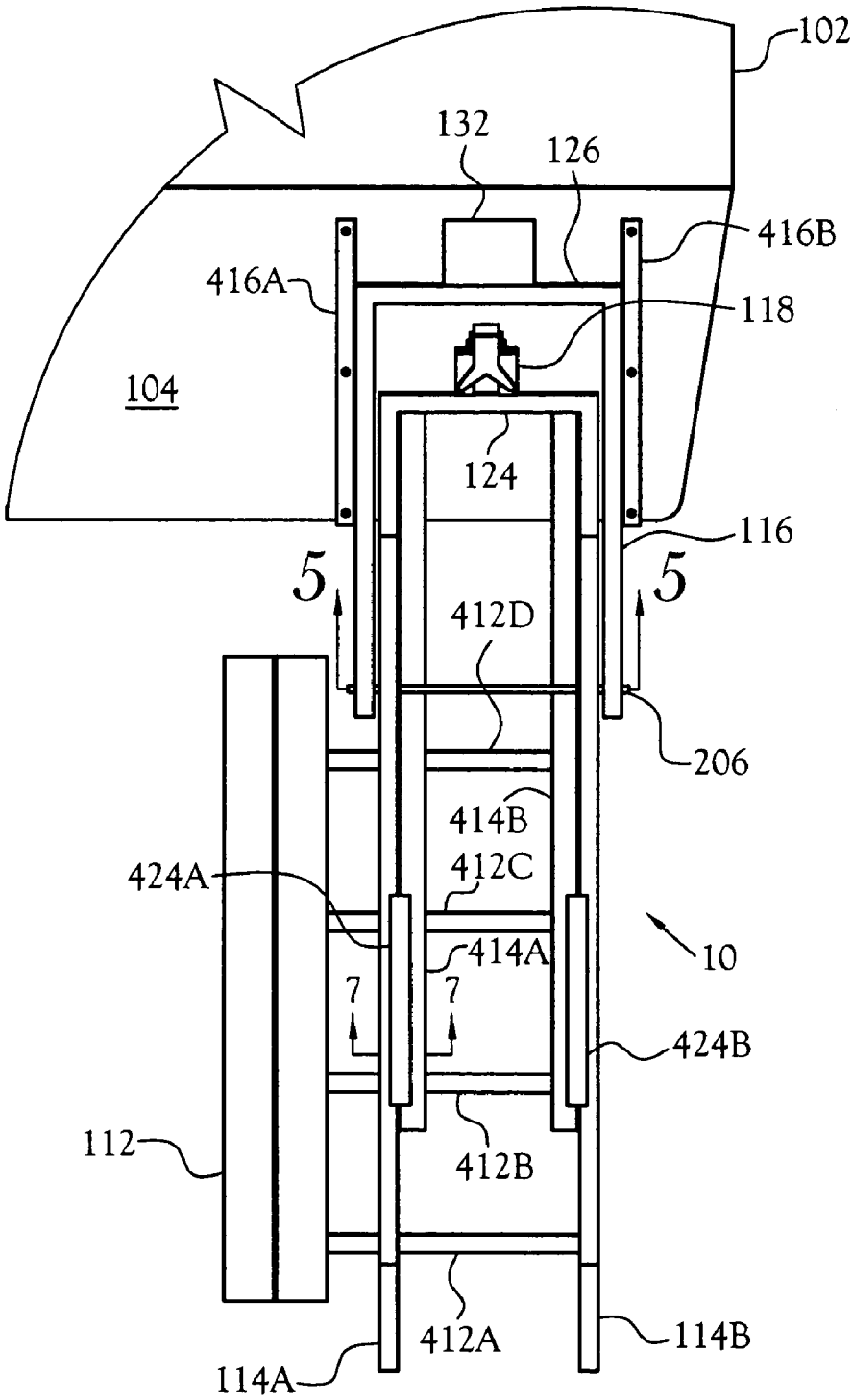
FIG. 4 is a plan view of the rack assembly.

FIG. 4 illustrates a top view of the rack assembly 10. The two rails 114A, 114B are connected at the end nearest the vessel 102 by a cross-member 124. The opposite end of the rails 114 have a chamfer (visible on FIGS. 1 to 3) such that the watercraft 108 meets a sloping surface when being driven onto the rack assembly 10. A portion of the top of each rail 114 is covered with a runner, or skid, 142A, 142B, which provides a slick surface for the watercraft 108 to slide as it enters and leaves the rack assembly 10. In one embodiment, the runners 142 are formed of a waterproof, mildew resistant, long-lasting, low-maintenance, and low coefficient of friction material. In one embodiment, the runners 142 are formed of ultra-high molecular weight (UHMW) plastic or polymer. In another embodiment, the runners 142 are formed of a Teflon material. In one embodiment, the runners 142 have chamfered or rounded edges.

Visible in FIG. 4 are a pair of friction strips 424A, 424B positioned approximately midway between the pivot point 206 and the outboard end of the rails 114. In the illustrated embodiment, these friction strips 424 are approximately two feet long and allow the watercraft 108 to be restrained when the watercraft 108 is positioned at the entry point of the rack assembly 10. That is, when the watercraft 108 is initially driven onto the rack assembly 10, the friction strips 424 hold the watercraft 108 in position while the operator disembarks the watercraft 108 and hooks the cable 202 onto the watercraft 108. When launching the watercraft 108, the winch 132 lowers the rack assembly 10 and the watercraft 108 slides down the rails 114 until the watercraft 108 is stopped by the friction strips 424, thereby allowing the operator to remove the cable 202 from the watercraft 108 and mount the watercraft 108. After mounting the watercraft 108, the operator can easily shift the watercraft 108 off the rack assembly 10 and maneuver upon the water.

Attached to the side of rail 114A is a walkboard, or platform, 112. In the illustrated embodiment, the platform 112 is attached to both rails 114A, 114B by members 412A, 412B, 412C, 412D. In one embodiment, the members 412 are angle welded to the rails 114. In one embodiment, the platform 112 is formed of a recycled plastic material, which is suitable for a wet environment. In another embodiment, the platform 112 has a textured or grooved surface to increase traction when wet.

Adjacent to each support arm 116A, 116B is an upper support angle 416A, 416B bolted to the swim platform 104. The upper support angles 416A, 416B secure the support arms 116A, 116B to the swim platform 104. In another embodiment, the upper support angles 416A, 416B are fastened to a platform that supports the rack assembly 10.

Figure 5:
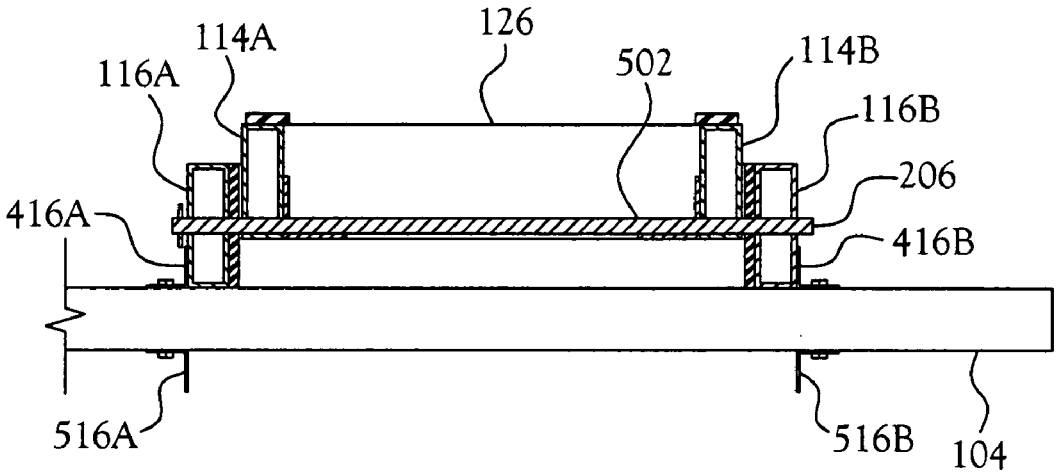
FIG. 5 is a cross-sectional view of the pivot point of the embodiment of the rack assembly shown in FIG. 4.
Figure 6:
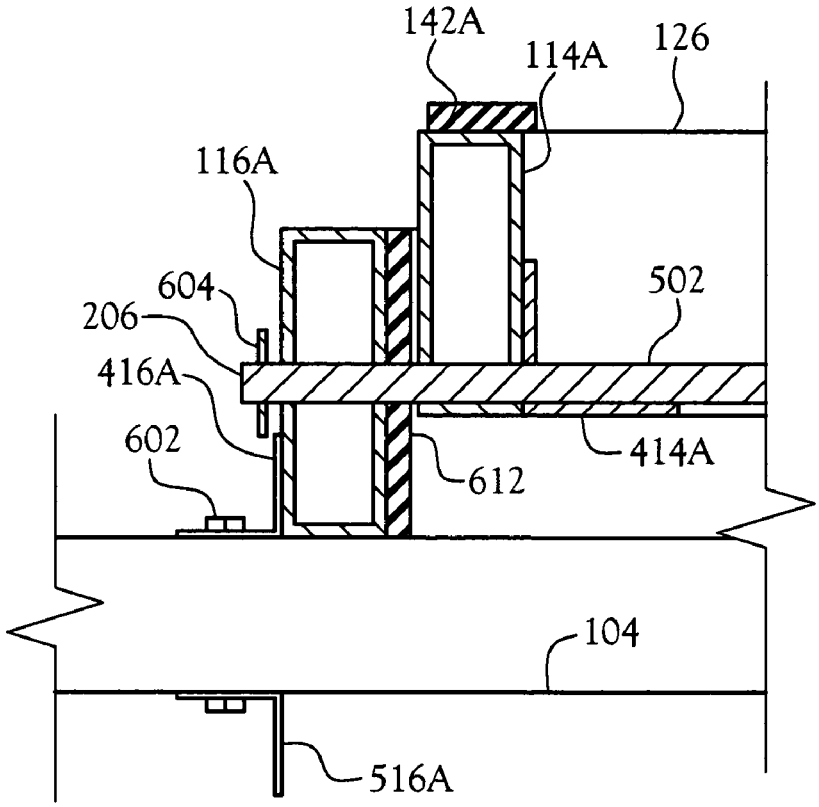
FIG. 6 is a partial cross-sectional view of one rail as shown in FIG. 5.

FIG. 5 is a cross-sectional view of the pivot 206. FIG. 6 is a close-up view of one end of the pivot 206. The support arms 116A, 116B are secured to the swim platform 104 by the upper support angles 416A, 416B and the lower support angles 516A, 516B. A fastener 602 passes through the upper support angle 416A, 416B, through the swim platform 104, and through the lower support angle 516A, 516B. In one embodiment, the upper support angles 416A, 416B are welded to the support arms 116A, 116B. In another embodiment, such was where the swim platform 104 is an integral part of a fiberglass hull, the support arms 116 and upper support angles 416 are bolted to the fiberglass swim platform 104 in a manner suitable for such a hull construction.

On the opposite side of the support arm 116A, 116B from the upper support angle 416 is a spacer plate 612, which is a flat plate, approximately ½ inch thick, that is positioned between the support arms 116A, 116B and the rails 114A, 114B. In another embodiment, a bearing sheet, such as a plastic or Teflon sheet, is placed between the spacer plate 612 and the rails 114. The bearing sheet prevents metal-to-metal contact or rubbing as the rails 114 rotate between the loading position and the stowed position. A hinge pin 502 passes through a hole in the support arms 116A, 116B and the spacer plate 612. In the illustrated embodiment, the hinge pin 502 has a cotter pin 604 to prevent the hinge pin 502 from drifting out. Those skilled in the art will recognize that other means of preventing the hinge pin 502 from drifting can be used without departing from the spirit and scope of the present invention.

Between the support arms 116A, 116B are the rails 114A, 114B. Near the lower edge of the rails 114, on the opposite side as the support arms 116A, 116B, are side angles 414A, 414B. In one embodiment, the side angles 414 are welded to the rails 114. The side angles 414, seen in plan on FIG. 4, extend along a substantial length of the rails 114, thereby providing rigidity to the rails 114. The rails 114 and the side angles 414 have openings for accepting the hinge pin 502. With the support arms 116 fixed to the swim platform 104, the rails 114 are free to pivot about the hinge pin 502. In the illustrated embodiment, the hinge pin 502 bears directly against the edges of the support arms 116, the rails 114, the spacer plate 612, and the side angles 414. In another embodiment, a bearing is used to allow the rails 114 to rotate about the support arms 116.

In another embodiment, a tube or pipe runs between the two spacer plates 612 with the hinge pin 502 running through the pipe. The pipe is attached to the pair of rails 114 and side angles 414, and the hinge pin 502 is secured to the support arms 116 such that the hinge pin 502 does not rotate. In this embodiment, as the pair of rails 114 rotates relative to the support arms 116, the contact between the pipe and the hinge pin 502 is the bearing surface for the pivot 206. In one embodiment, the pipe is seal welded to the rails 114, thereby preventing water intrusion to the interior of the rails 114.

In another embodiment, the support arms 116 are replaced by support members that include a pivot 206. In this embodiment, the support members are mounted to a platform, such as the swim platform 104, with the pivot 206 located at the edge of the platform. In other embodiments, the pivot 206 is located either inboard or outboard of the platform edge. In these embodiments, the pivot 206 is located at such a height that the inboard end of the rails 114 is slightly lower than the outboard, or aft, end of the rails 114 when the rails 114 are in the stowed position.

The spacer plate 612 between the support arms 116 and the rails 114 provides room for the rail stop 214 and the support stop 216 to move with their corresponding support arm 116 or rail 114. In one embodiment, the stops 214, 216 are ½×½ aluminum bar stock welded to the support arms 116 and rails 114, and the spacer plate 612 is ½ inch thick plating. In this manner, the spacer plate maintains a gap between the support arm 116 and the rail 114, and the stops 214, 216 are free to rotate about the pivot 206 without binding against the adjacent support arm 116 or rail 114. In another embodiment, a bearing sheet is disposed between the spacer plate 612 and the rails 114, and the bearing sheet provides additional clearance for the stops 214, 216 and also prevents metal-to-metal contact between the spacer plate 612 and the rails 114.

Seen in cross-section atop the rails 114 are the runners, or skids, 142. The runners 142 provide a bearing surface for the watercraft 108 to slide against as the watercraft 108 is positioned on the rails 114. In one embodiment, the runners 142 are secured to the rails 114 with fasteners.

Figure 7:
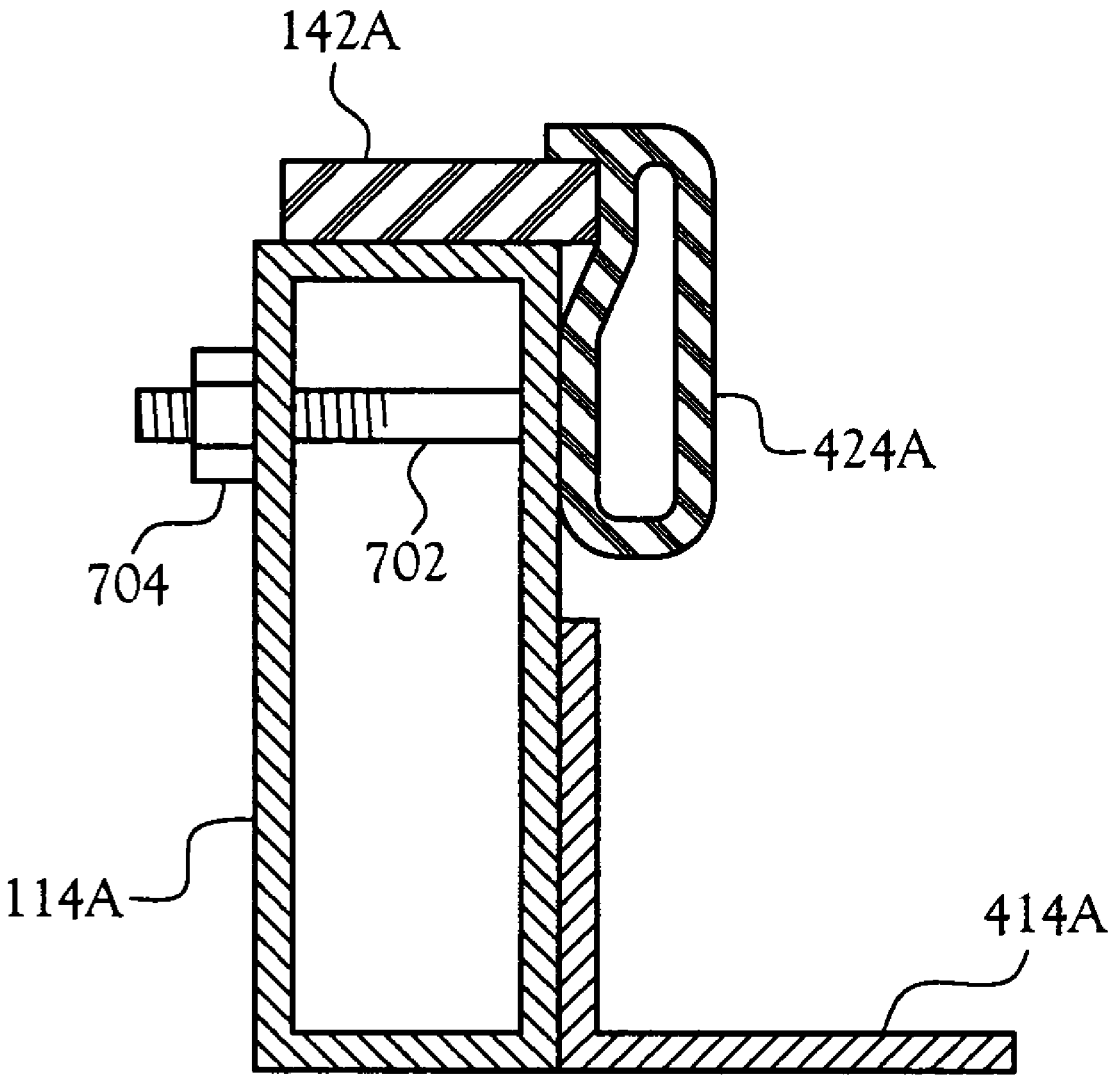
FIG. 7 is a cross-sectional view of one rail and friction strip.

FIG. 7 illustrates a cross-section of the rail 114A and its associated friction strip 424A. In the illustrated embodiment, the friction strip 424 is a section of dock bumper that is fastened to the rails 114. FIG. 7 shows the friction strip 424 in its natural shape positioned along the inside surface of the rail 114 and atop the runner 142A. In the illustrated embodiment, a bolt 702 extends through the friction strip 424 and through the rail 114. The protruding end of the bolt 702 is secured with a nut 704. The head of the bolt 702 is not visible in FIG. 7 because the bolt 702 is not shown intersecting the cross-sectional plane, but is shown some distance beyond the cross-sectional plane. The friction strip 424 is compressed by the bolt 702 where the strip 424 is fastened to the rail 114. Those skilled in the art will recognize that other means besides a bolt 702 and nut 704 can be used to secure the friction strip 424 to the rails 114 without departing from the spirit and scope of the present invention.

The rack assembly 10 includes various functions. The function of holding a watercraft 108 is implemented, in one embodiment, by the pair of rails 114 that are adapted to cradle the watercraft 108. In another embodiment, the function further includes a runner 142 attached to each rail 114. In still another embodiment, the function further includes a bumper 204 adapted to mate with the bow of the watercraft 108. In yet another embodiment, the function further includes at least one friction strip 424 attached to at least one rail 114.

The function of securing the pair of rails 114 in a loading position is implemented, in one embodiment, by at least one rail stop 214 contacting at least one support stop 216 as the rails 114 rotate about the pivot point 206. As the rails 114 rotate into the loading position, the stops 214, 216 approach each other until they contact, at which time the rails 114 reach the loading position and the rails 114 stop rotating.

The function of pulling the watercraft 108 onto the pair of rails 114 is implemented, in one embodiment, by the winch 132 retracting the cable 202 attached to the watercraft 108, thereby causing the watercraft 108 to slide along the rails 114. In another embodiment, the runners 142 attached to the rails 114 assist the watercraft 108 in sliding along the rails 114.

The function of moving the pair of rails 114 from a loading position into a stowed position is implemented, in one embodiment, by the winch 132 retracting the cable 202 attached to the watercraft 108 with the watercraft 108 against the bumper 204, thereby causing the pair of rails 114, with the watercraft 108 on them, to rotate about the pivot point 206.

The function of accessing the watercraft is implemented, in one embodiment, by a walkway 112 attached to at least one of the pair of rails 114. The walkway 112 is adjacent the watercraft 108 on the pair of rails 114 and allows a person to stand next to the watercraft 108 in addition to providing a place for a person exiting or entering the watercraft 108 to place a foot.

From the foregoing description, it will be recognized by those skilled in the art that a rack assembly 10 adapted to lift and carry a watercraft 108 out of the water has been provided. The rack assembly 10 includes a pair of rails 114 for supporting the watercraft 108. The pair of rails 114 pivot relative to a pair of support arms 116 whereby the watercraft 108 is winched aboard the pair of rails 114 and the pair of rails 114 are pivoted out of the water into a stowed position. The rack assembly 10 presents a low silhouette suitable for houseboats and other pleasure craft, in addition to floating docks and piers. Further, the rack assembly 10 permits an easy method for pulling the watercraft 108 onto the rack assembly 10 and for rotating the rails 114 into a stowed position. The rack assembly 10 requires the use of only a single winch 132 to pull the watercraft 108 onto the rails 114 and to position the rails 114 in a stowed position.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for lifting and carrying a watercraft out of the water, said apparatus comprising:

a pair of support members attached to a surface, said support members having at least one support stop;

a pair of rails attached to said pair of support members at a pivotal axis, said pair of rails having a first end, said pair of rails having a loading position and a stowed position, said pair of rails having at least one rail stop, said at least one rail stop cooperating with said at least one support stop to position said pair of rails at said loading position;

a friction strip attached to each of said pair of rails, each said friction strip positioned to prevent the watercraft from sliding completely off of said pair of rails;

a pulley in fixed relation to said first end of said pair of rails, said pulley located above a plane defined by said pair of rails;

a bumper in fixed relation to said first end of said pair of rails, said bumper adapted to mate with a bow of the watercraft;

a winch fixed relative to said pair of support members, said winch having a cable cooperating with said pulley, said cable having a means for attaching to the watercraft, said winch adapted to retract said cable with said cable attached to the watercraft, said winch for pulling the watercraft onto said pair of rails until the watercraft contacts said bumper, at which time said cable rotates said pair of rails about said pivotal axis, moving said pair of rails, and the watercraft, into said stowed position.

2. The apparatus of claim 1 further including a pair of runners, each said runner attached to one of said pair of rails for sliding the watercraft along said pair of rails.

3. The apparatus of claim 1 wherein said cable is one of a rope and a strap.

4. The apparatus of claim 1 further including a walkboard attached to at least one of said pair of rails, said walkboard adapted for a person to stand beside the watercraft.

5. The apparatus of claim 1 wherein said pair of support members are secured to one of a swim platform, a boat deck, and a dock.

6. The apparatus of claim 1 wherein said pivotal axis includes a bar transversely positioned relative to said pair of support members and said pair of rails, said bar having a circular cross-section.

7. The apparatus of claim 1 further including a hollow member extending between said pair of rails at said pivotal axis and a bar positioned inside said hollow member, said bar rotating relative to said hollow member when said pair of rails moves between said loading position and said stowed position.

8. An apparatus for lifting and carrying a watercraft out of the water, said apparatus comprising:

a means for holding a watercraft;

a means for securing said means for holding in a loading position;

a means for pulling the watercraft onto said means for holding; and a means for moving said means for holding from a loading position into a stowed position.

9. The apparatus of claim 8 further including a means for accessing the watercraft.

10. An apparatus for lifting and carrying a watercraft out of the water, said apparatus comprising:

a rail member attached at a pivotal axis, said rail member having a first end, said rail member having a loading position and a stowed position;

a pulley in fixed relation to said first end of said rail member;

a winch fixed relative to said pivot point, said winch having a cable cooperating with said pulley, said cable having a means for attaching to the watercraft, said winch adapted to retract said cable with said cable attached to the watercraft, said winch for pulling the watercraft onto said rail member until the watercraft is cradled by said rail member, at which time said cable rotates said rail member about said pivotal axis, moving said rail member into said stowed position; and a walkboard attached to said rail member, said walkboard adapted for a person to stand beside the watercraft.

11. The apparatus of claim 10 wherein said rail member includes a pair of rails.

12. The apparatus of claim 10 wherein said rail member includes at least one friction strip, said at least one friction strip positioned to prevent the watercraft from sliding completely off of said rail member.

13. The apparatus of claim 10 further including at least one runner, said runner attached to said rail member for sliding the watercraft along said rail member.

14. The apparatus of claim 10 further including a bumper in fixed relation to said first end of said rail member, said bumper adapted to mate with a bow of the watercraft.

15. The apparatus of claim 10 wherein said rail member has a second end opposite said first end, said second end of said rail member having a bevel, said bevel presenting a sloping surface for engaging the watercraft with said rail member in said loading position.

16. The apparatus of claim 10 further including at least one support stop in fixed relation to said pivotal axis, said rail member having at least one rail stop, said at least one rail stop cooperating with said at least one support stop to position said rail member at said loading position.

17. The apparatus of claim 10 wherein said pivotal axis is in fixed relation to one of a swim platform, a boat deck, and a dock.

18. The apparatus of claim 10 further including a hollow member extending along said pivotal axis and a bar positioned inside said hollow member, said hollow member attached to said rail member, said bar rotating relative to said hollow member when said rail member moves between said loading position and said stowed position.

19. The apparatus of claim 10 wherein said cable is one of a rope and a strap.

* * * * *